US006428243B1

(12) United States Patent
Hutchins

(10) Patent No.: US 6,428,243 B1
(45) Date of Patent: Aug. 6, 2002

(54) CABLE BOLT

(75) Inventor: Warwick Bernard Hutchins, Kew (AU)

(73) Assignee: Quantax PTY LTD, Heidelberg (AU)

( * ) Notice: Subject to any disclaimer, the term of this patent is extended or adjusted under 35 U.S.C. 154(b) by 0 days.

(21) Appl. No.: 09/147,795

(22) PCT Filed: Sep. 9, 1997

(86) PCT No.: PCT/AU97/00587

§ 371 (c)(1),
(2), (4) Date: Jul. 14, 1999

(87) PCT Pub. No.: WO98/11324

PCT Pub. Date: Mar. 19, 1998

(30) Foreign Application Priority Data

Sep. 9, 1996 (AU) ..... PO2205

(51) Int. Cl.[7] ..... E02D 20/02; E02D 21/00

(52) U.S. Cl. ..... 405/259.1; 405/259.5; 405/302.2; 411/8; 411/82

(58) Field of Search ..... 405/259.1, 259.2, 405/259.3, 259.4, 259.5, 259.6, 288, 302.1, 302.2, 302.3, 147, 152, 153, 239, 244; 411/82, 383, 385, 907, 908, 401, 402, 1, 8, 9, 10, 11, 14

(56) References Cited

U.S. PATENT DOCUMENTS

| | | | | | |
|---|---|---|---|---|---|
| 3,651,651 | A | * | 3/1972 | Triplett | 405/259.3 |
| 4,140,429 | A | * | 2/1979 | Herbst | 405/259.6 |
| 4,369,003 | A | * | 1/1983 | Brandstetter | 405/259.3 |
| 4,449,855 | A | * | 5/1984 | Langwadt | 405/259.5 |
| 4,664,555 | A | * | 5/1987 | Herbst | 405/259.5 |
| 4,704,053 | A | * | 11/1987 | Hipkins, Sr. et al. | 405/259.6 |
| 4,765,778 | A | * | 8/1988 | Valentine | 405/259.5 |
| 4,798,501 | A | * | 1/1989 | Spies | 405/259.5 |
| 4,865,489 | A | * | 9/1989 | Stankus et al. | 405/259.3 |
| 5,417,521 | A | * | 5/1995 | Scott | 405/259.6 |
| 5,525,013 | A | * | 6/1996 | Seegmiller et al. | 405/259.3 |
| 5,531,545 | A | * | 7/1996 | Seegmiller et al. | 405/259.4 |
| 5,586,839 | A | * | 12/1996 | Gillespie | 405/259.1 |
| 5,647,694 | A | * | 7/1997 | Locotos | 405/259.4 |
| 5,785,463 | A | * | 7/1998 | Eaton et al. | 405/302.2 |
| 5,919,006 | A | * | 7/1999 | Calandra, Jr. et al. | 405/302.2 |
| 5,954,455 | A | * | 9/1999 | Eaton et al. | 405/259.6 |

FOREIGN PATENT DOCUMENTS

| | | | | |
|---|---|---|---|---|
| DE | 3905128 | * | 1/1990 | 405/259.1 |
| GB | 2144784 | * | 3/1985 | 405/259.5 |
| JP | 09125895 | * | 5/1997 | |

* cited by examiner

*Primary Examiner*—Heather Shackelford
*Assistant Examiner*—Jong-Suk Lee
(74) *Attorney, Agent, or Firm*—Dennison, Schultz & Dougherty

(57) ABSTRACT

A cable bolt (10) for use in mining excavations comprising a plurality of generally closely spaced wires or strands (11) which have a first end for fitting into a bore hole (21) formed in an excavation and a second end which is terminated within a cylindrical sleeve (17). The sleeve (17) has a threaded external surface for receiving a lock nut (18) which is tightened against a bearing plate (19) so as to tension the cable bolt (10). The wires or strands (11) are separated outwardly from a central longitudinal axis of the cable bolt (10) at spaced locations along the length of the cable bolt to form a "bird cage" (13) at each location. Spacers (14) are provided at each location to cause the outward separation of the wires or strands (11). A central tubular member (12) extends along the axis through the sleeve (17) and each spacer (14).

28 Claims, 4 Drawing Sheets

CABLE BOLT

BACKGROUND OF THE INVENTION

1. Field of the Invention

The present invention relates to cable bolts for use in the mining and construction industries to support the walls and roofs of underground excavations and openings and particularly, although not exclusively, to cable bolts for use in coal mining where the softer excavation material generally requires differing considerations to those in metalliferous mining.

2. Description of the Related Art

In coal mines the cable bolt is normally fixed at the inner end of a hole drilled in the mine roof by means of a two part quick curing resin. The epoxy resin is inserted into the hole in separate packaged parts and pushed to the end of the hole by insertion of the cable bolt which also causes destruction of the packaging and mixing of the parts. Rotation of the bolt during full insertion ensures proper mixing of the resin which quickly cures to secure the top of the cable bolt in the hole. In some circumstances cement grouting is then pumped into the hole to secure the bolt along its entire length, to the sides of the hole.

One known form of cable bolt for coal mines is marketed under the name FLEXIBOLT®, a registered trade mark of JJP Geotechnical Engineering Pty. Ltd., and comprises a number of outer wires or strands wound around a central core of smaller diameter wires or strands in a helical fashion to form a bar which constitutes the main part of the cable bolt. The lower end of the bolt, that is, the end external of the hole in use, has a thread rolled into the surface of the bolt which, because of the irregular outer surface of the bolt, is a discontinuous thread only occurring in the outermost surface of each of the outer wires or strands. A nut having a thin metal plate pressed into one end is adapted to be wound on the thread until initially the plate bears on the end of the cable bolt and prevents further progress of the nut. Further rotation of the nut by a standard drive mechanism causes rotation of the entire cable bolt to thereby mix the two part resin until the resin cures, at which time the top end of the bolt is firmly anchored and further rotation of the nut causes the plate to be forced out of the nut and the nut to progress along the threaded end of the cable bolt. A bearing plate pre-arranged on the cable bolt and a conventional barrel and wedge between the bearing plate and nut are therefore forced upwardly by the further rotation of the nut against the roof of the mine until sufficient tension is applied to the cable bolt by the rotation of the nut. While the aforementioned FLEXIBOLT® cable bolt is used quite extensively there are some features thereof which render it less than ideal. Most significantly the combination of the nut, barrel and wedge, does not normally give an anchorage force equivalent to the strength of the cable bolt, as it would require a disproportionately long barrel and wedge which, apart from cost considerations would extend downwardly into the mine an unacceptable distance. Furthermore, it is not possible with the FLEXIBOLT® device to provide additional bonding such as grouting over the remaining length of the bolt as there is no means for getting the grouting into the hole after the bearing plate and barrel and wedge are in position. Therefore, the FLEXIBOLT® device must rely only on the bonding achieved by the resin which extends about two meters down from the top of the bolt and consequently full bonding is difficult to achieve. The nut and rolled thread combination is not capable of developing more than about 30% of the ultimate tensile strength (UTS) of the cable due to the non-continuous thread and therefore the cable bolt cannot be pre-tensioned beyond about 30% of the UTS by rotation of the nut alone.

SUMMARY OF THE INVENTION

It is an object of this invention to provide a cable bolt for use in coal mines which overcomes one or more of the shortcomings of the "Flexibolt"™ or at least provides a useful alternative.

Accordingly, one broad form of the invention which may be preferred provides a cable bolt comprising a plurality of generally closely spaced elongate wires or strands, said wires or strands having a first end adapted for fitting into a bore hole and a second end being terminated within a cylindrical sleeve, said cylindrical sleeve having a threaded external surface to receive a lock nut for tightening against a bearing plate so as to tension said cable bolt.

Preferably said termination of said second end of said wires or strands comprises a transverse plate in said cylindrical sleeve, said transverse plate having individual holes for each wire or strand and each wire or strand passes through a respective termination hole and has an enlarged head which is larger than the diameter of the termination hole whereby the wire or strand cannot be withdrawn from the said respective termination holes.

Preferably said wires or strands are separated outwardly from a central longitudinal axis of the cable bolt at discrete spaced locations along the length of the cable bolt to provide a "bird cage" at each location.

In one more specific form of the invention the wires or strands are straight and parallel to the longitudinal axis between each bird cage and in an alternative form said wires or strands have a slight helical configuration over the length of the cable bolt.

Preferably, coupling means such as a drive nut suitable for engagement with an industry standard square or hexagonal drive is provided in the lower end of said sleeve for the purpose of rotating said cable bolt.

In one more specific form said lock nut has a connection for receiving a grout tube and said connection provides access to an annular chamber formed within said lock nut, said annular chamber being against said bearing plate and said bearing plate having a bore therethrough which is greater in diameter than the outer diameter of said sleeve whereby said annular chamber is open to a space between said cable bolt and a wall of a bore hole in the mine roof into which the cable bolt is inserted, whereby grout is pumped through said grout tube and enters said bore hole in the mine roof.

In an alternative more specific form of the invention said grout enters said annular chamber via said coupling means.

Preferably, located along the longitudinal axis of said cable bolt is a central elongate tubular member which may be hollow and which extends over a substantial length of said cable bolt to act as an air bleed tube when grout is pumped into said bore hole, said tube extending through said sleeve and coupling means.

Preferably, a resin seal is provided on said cable bolt at a spaced location from said first end of said wires or strands to prevent resin, used to bond the first end of said wires or strands to the wall of the bore hole, from passing downwardly below said seal, said resin seal comprising a sleeve that fits over said wires or strands and said elongate tubular member terminating within said resin seal.

Preferably, spacers are provided at spaced locations around said elongate tubular member to cause said wires or strands to spread outwardly and form said bird cages.

Another preferred form of the invention provides a cable bolt for use in an excavation comprising a plurality of generally closely spaced elongate wires or strands having a first end adapted for fitting into a bore hole formed in said excavation and a second end adapted for bearing against the excavation surface wherein the terminal region of said second end of said wires or strands terminates in a cylindrical sleeve having a threaded external surface adapted to co-operate with a threaded lock nut for tightening said cable bolt against said excavation.

BRIEF DESCRIPTION OF THE DRAWINGS

In order that the invention may be more readily understood reference should be made to the accompanying drawings wherein.

DETAILED DESCRIPTION OF THE INVENTION

Figure 1:
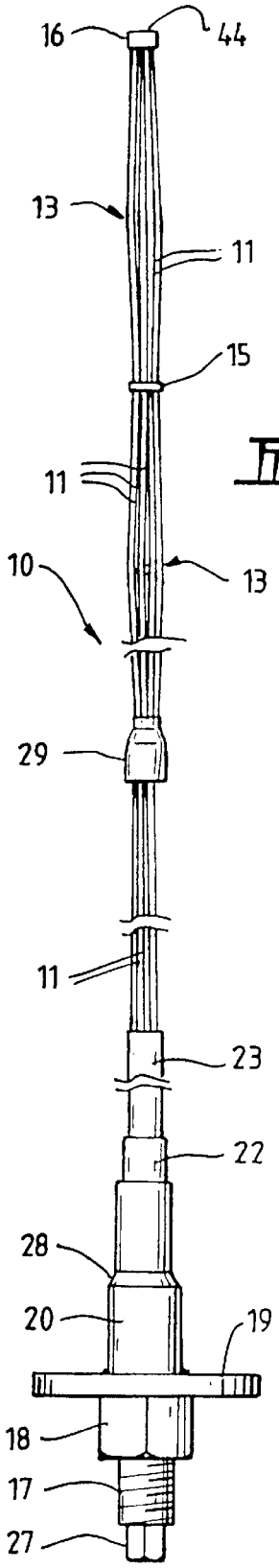
FIG. 1 is a front elevation of a cable bolt according to a first embodiment of the invention.

The cable bolt 10 consists essentially of a number of wires or strands 11 extending over the length of the cable bolt and spaced around a central member 12 (FIGS. 2, 4) which is preferably elongate and tubular. The central member 12 is a hollow metal or plastics tube in this embodiment but in situations where the cable bolt is not to be grouted after installation, the central member 12 may merely comprise a further wire similar to the wires or strands 11 but arranged centrally along the longitudinal axis of the cable bolt 10.

In the embodiments of FIGS. 1 to 5, the strands 11 are essentially straight and parallel with the central strand 12 except for points along the length of the cable bolt where the strands are flared outwardly to form a "bird cage". For the purpose of forming each "bird cage" 13, a spacer 14 in the form of a nut or annular ring (see FIG. 5) is provided around the central member 12 and the strands 11 are caused to bow out over the spacer 14 thus providing the "bird cage" 13. The bird cage 13 exposes a greater surface area of each of the strands 11 to provide increased bonding for the resin and additionally for grout, where it is used. Spaced collars 15 at either side of each "bird cage" clamp the wires back together against the central strand 12.

The strands 11 are terminated at a first end 44, in use, by a terminal collar 16 which is welded to the strands 11 or alternatively the strands 11 may be merely welded together at the first end 44.

Figure 7:
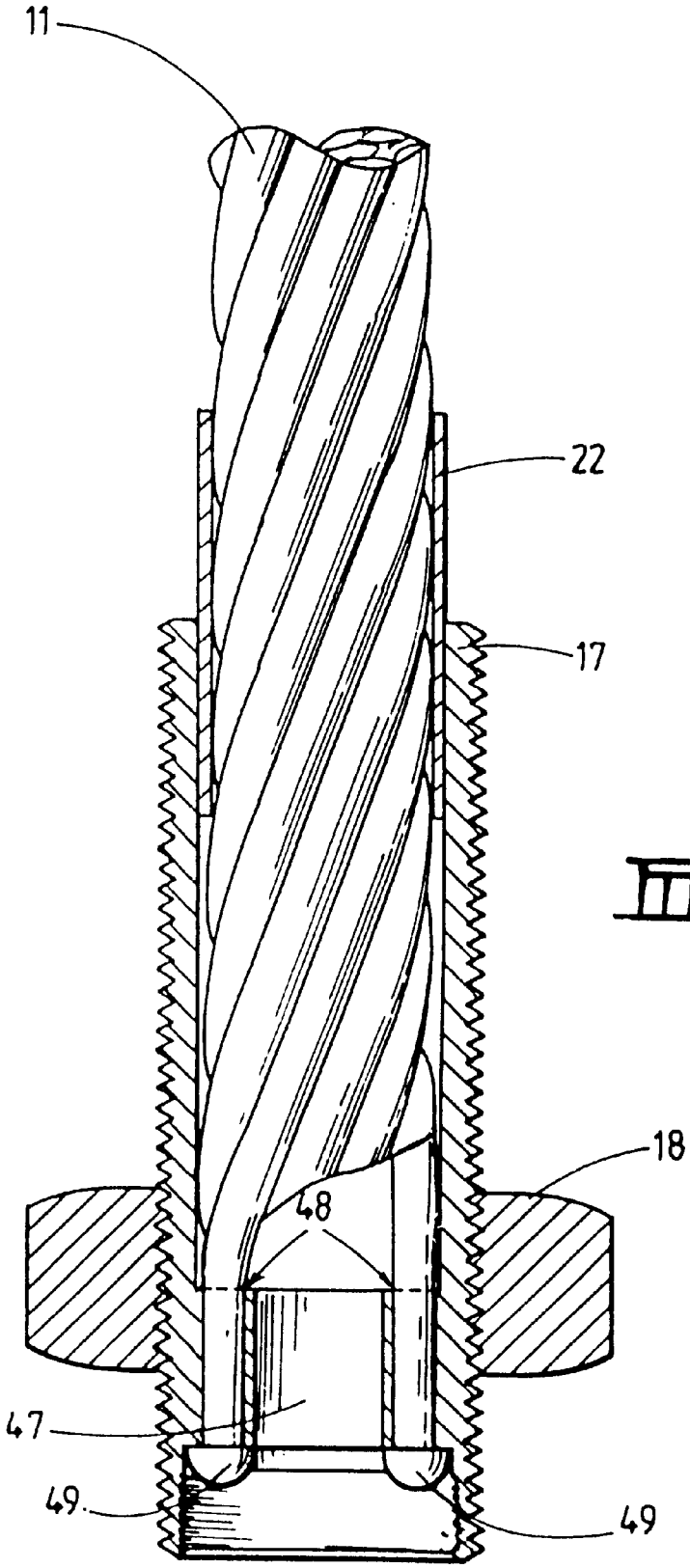
FIG. 7 is an enlarged sectional view of a portion of the lower end of a cable bolt according to the invention.

A second end of the wires or strands 11 enter a cylindrical sleeve 17 in which the second end is terminated. The second end termination of the wires or strands 11 is shown more clearly in FIG. 7 and consists of a transverse plate 47 in the sleeve 17 having individual holes 48 for each strand 11. Each strand 11 passes through a respective hole and is provided with an enlarged head 49 in the form of a button end which is larger than the diameter of each respective hole 48 thereby preventing withdrawal of the strands 11 from the sleeve 17. The plate may be an integral part of the sleeve 17 as is the case in FIG. 7. As shown the sleeve 17 is threaded on its outer surface to receive lock nut 18 which is shown in more detail in FIG. 2. The lock nut 18 is tightened in use against bearing plate 19 to tension the cable bolt 10 to provide the required tension for supporting the roof of a mine.

The bearing plate 19 is provided with a "trumpet" 20 which is welded to the bearing plate 19 and consists of a stepped cylindrical tube adapted to extend a short distance into the bore hole 21 which is drilled in the mine roof for accommodating the cable bolt. Collar pipes 22 and 23 extend concentrically from the sleeve 17 by means of the collar pipe 22 being inserted into the end of the sleeve 17 and the collar pipe 23 being inserted in the end of the collar pipe 22. The purpose of these collar pipes 22 and 23 is to provide stiffening to the lower end of the cable bolt when required. In an alternative embodiment only a single collar pipe with expanded section is used.

Figure 2:
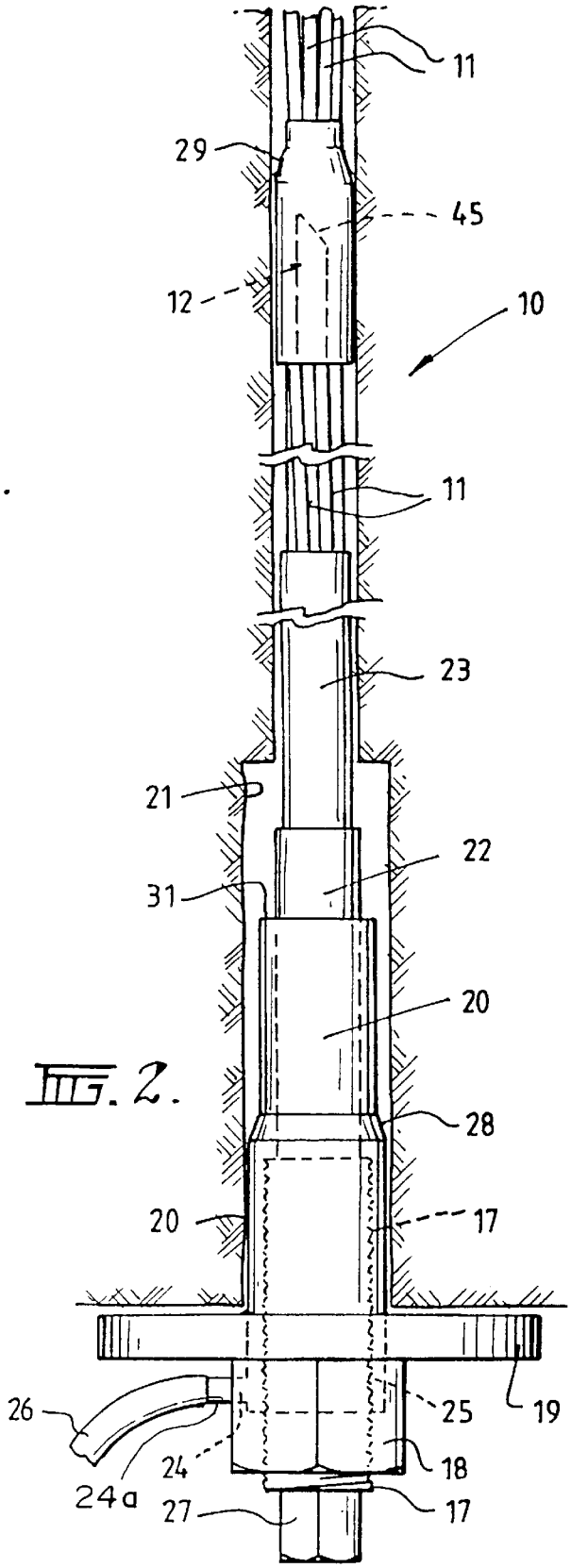
FIG. 2 is an enlarged view of a portion of the cable bolt shown in FIG. 1.

As is shown in FIG. 2, the lock nut 18 has a bore 24 in the side of the nut which extends radially inwardly to an annular chamber 25 provided in the upper end of the nut 18. The bearing plate 19 has a hole through which the sleeve 17 of the cable bolt passes and the hole in the bearing plate has clearance around the sleeve. Thus there is a passage from the annular chamber 25 through the bearing plate 19 and into a space which exists between the trumpet 20 and the sleeve 17. A grout tube 26 is connected to the bore 24 by means of a suitable connection 24*a*. Thus, grouting, which is typically in the form of "liquid" grout, pumped into the grout tube 26 enters the annular chamber 25 and passes up through the trumpet 20 and into the bore bolt 21 accommodating the cable bolt 10. In another from the grout may enter via coupling means such as a drive nut 27 which is fixed into the end of the sleeve 17 and is of a size that will be readily engageable with an industry standard hexagonal or square drive for the purpose of rotating the cable bolt during insertion into the bore hole. Alternatively a screw coupler or any other coupling means that is engageable to sleeve 17 may be used.

A trumpet seal 30 in the form of either foam or an "O" ring is adapted to fit around the trumpet 20 immediately above either of the stepped sections 28 or 31 for the purpose of sealing the cable bolt against the side of the bore hole. The trumpet seal 30 assists in centering the trumpet 20 and sleeve 17 within the bore 21 to prevent damage to the external thread of sleeve 17 against the surface walls formed by the bore 21. A further seal in the form of a tapered tubular resin seal 29 is provided over the strands of the cable bolt at a location spaced about 2 meters from the first end 44 of the wires or strands 11. In the case wherein the central member 12 is a hollow metal or plastics tube, it terminates at an upper end 45 within the resin seal 29 as is shown in FIG. 2.

Figure 3:
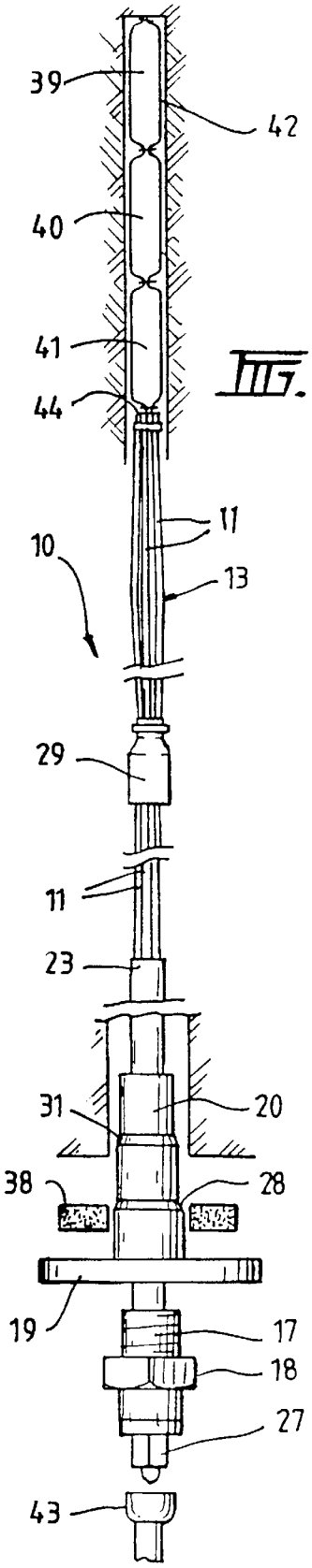
FIG. 3 is a front elevation of a cable bolt according to a second embodiment of the invention.
Figure 4:
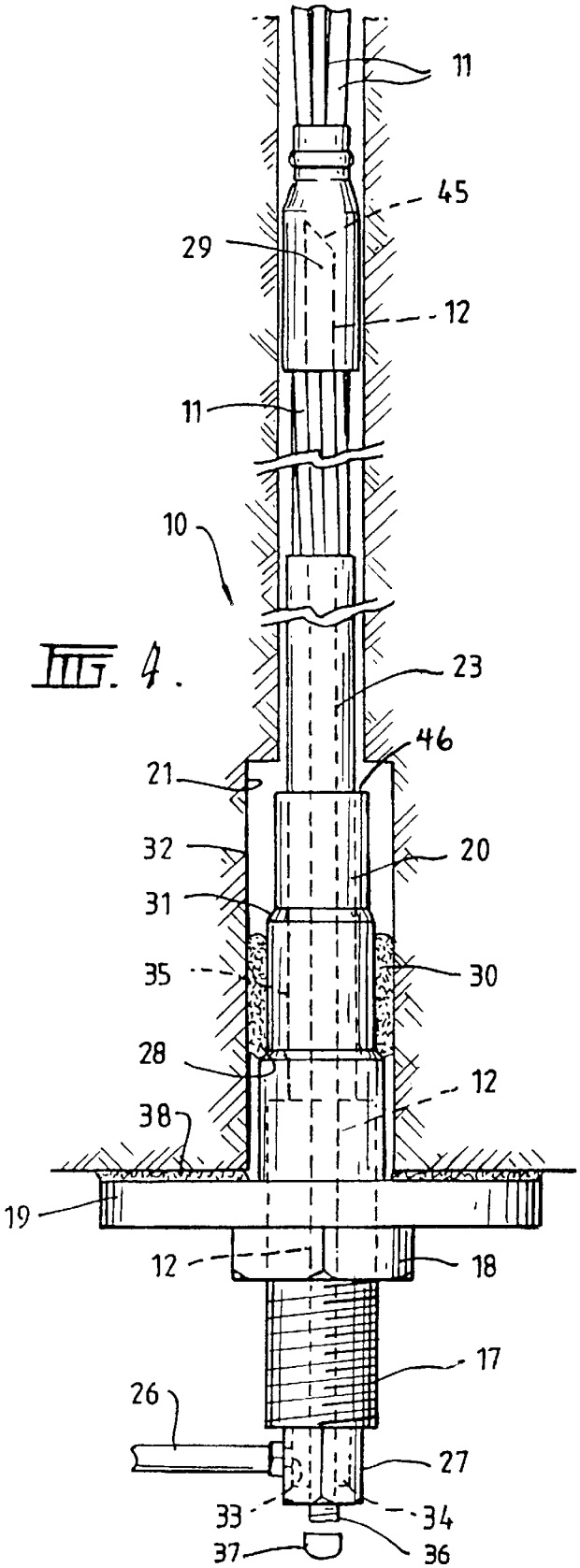
FIG. 4 is an enlarged view of a portion of the cable bolt shown in FIG. 3.
Figure 5:
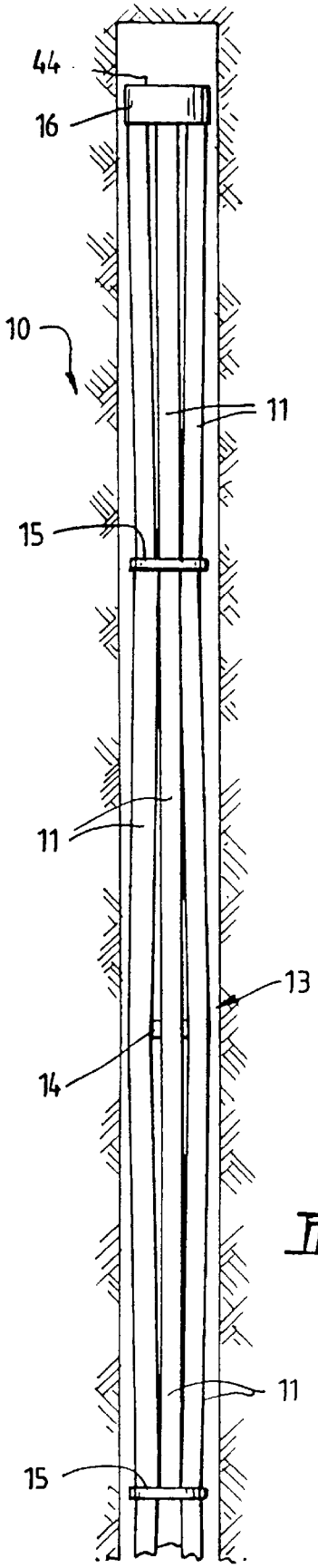
FIG. 5 is an enlarged view of a portion at the top end of the cable bolt of FIGS. 1 and 2.

In the second embodiment shown in FIGS. 3 and 4, the locking nut 18 is substantially thinner in width and does not have an annular chamber compared with the embodiment of FIGS. 1 and 2, to enable the substantially thinner nut 18 to have the required strength. For situations where grouting is required, the grout is pumped into grout tube 26 (FIG. 4) which is connected to coupling means such as a drive nut 27 by suitable connection means and is in communication with a bore 33. As an alternative to using drive nut 27, a screw coupler or any coupling device that is welded, press-fitted into sleeve 17 may be used. The screw coupler may be threaded with limited depth so that when it is screwed onto the lower end of sleeve 17, it will eventually lock so that further rotation of the coupler will result in rotation of the cable bolt 10. The bore 33 opens up into an annular cavity 34 surrounding the central member 12 in the drive nut 27. The drive nut 27 is externally threaded at its upper end and engages a corresponding internal thread of sleeve 17. The annular cavity 34 extends upwardly through sleeve 17, locking nut 18, bearing plate 19 into a space 35 between trumpet 20 and collar pipe 23. The grout fills the annular cavity 34 and space 35 until it is expelled from the top portion 46 of trumpet 20 and fills the bore hole 21. The trumpet seal 30 prevents any grout flowing downwardly past the seal itself so that with continued pumping the bore 21 will fill until it reaches the upper end termination 45 of the central member 12 in resin seal 29. During the process, air is bled out from the bore hole 21 and is forced out down the interior of hollow central member 12 until it is expelled from the lower end 36 thereof. The grout follows downwardly through the central member 12 so that when it exits the lower end 36 it provides an indication that the grouting process is complete. A cap 37 may be screwed onto end 36 to prevent any further egress of the grout.

There may exist a number of cracks or channels in the mine walls or roof that meet at various openings to the bore hole 21. It is possible that grout being pumped into the bore hole 21 will fill up these channels with the result that the grout does not reach the resin seal 29 and enter the central member 12. There will therefore be no indication of the grout covering a substantial length of the cable bolt 10 up to the resin seal 29. To overcome this, an option to the user is to have the grout pumped in a reverse manner, that is, pumping the grout up the central member 12 first and letting the grout fill up the space between the cable bolt 10 and the walls 32 of the bore hole 21. To facilitate this, the grout tube 26 is directly connected (not shown) to a lower part of central member 12 so that it is in communication with the central member 12. Grout, which in this application is typically thixotropic, is then pumped into the central member 12 until it fills whereupon further pumping forces grout to flow out of the upper end 45 of central member 12 in resin seal 29 and then substantially fills up the bore hole 21. The seal 30 and/or an additional seal 38 prevent the grout from exuding outwardly of the hole 21 past the bearing plate 19. The air originally existing in the bore hole 21 is expelled through the channels or cracks if they exist.

In use, the cable bolt is installed in the roof of a mine by firstly drilling a stepped bore hole 21 in the mine roof to the required length. Next, a two part resin adhesive in separate plastic packs 39, 40 and 41 is placed in the hole and is pushed upwardly to the top of the hole by insertion of the cable bolt 10. When the resin has reached the inner end 42 of the hole further insertion of the cable bolt fractures the packaging and the two parts of the resin are allowed to mix. Rotation of the cable bolt 10 by means of applying driving dolly 43 to the drive nut 27 causes further mixing of the resin which extends from the first end 44 of the wires or strands 11 of the cable bolt to the resin seal 29. The resin is quick curing and once cured further rotation of the cable bolt is prevented. Thus, the cable bolt is then secured in the bore hole 21 at the upper end 42 and the lock nut 18 is tightened to force the bearing plate 19 against the mine roof. Once the required tension in the cable bolt has been reached, the mine roof is secured. If the cable bolt is to be grouted over its entire length, grouting is pumped via the grout tube 26 until it fills the bore hole and all the spaces surrounding the strands 11 up to the resin seal 29. During the first application of this process where the grout is first pumped through annular cavity 34, air is bled from the bore hole via the hollow central tube 12 and since this central tube 12 extends outwardly through the drive nut 27 at the bottom of the cable bolt, evidence that grouting has been completed occurs when the grouting appears at the bottom of the central member 12. Installation is then complete.

As indicated previously, in an alternative embodiment where the cable bolt is not to be grouted into the hole, the central hollow tube 12 may be replaced by a solid wire or strand.

Figure 6:
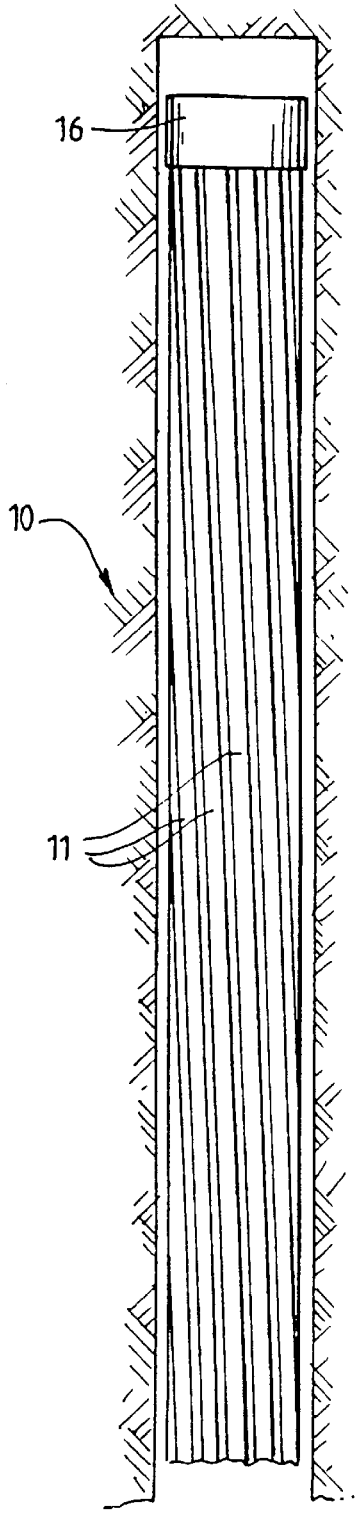
FIG. 6 is an enlarged view of a portion of the top end of an alternative cable bolt.

FIG. 6 shows an alternative form of the cable bolt where the strands 11 assume a helical path around a central strand which is not evident in the FIGURE. The degree of the helical twisting of the strands is relatively slight.

It should be evident from the description hereinabove that the cable bolt of the present invention provides advantages over existing cable bolts. For example, the cylindrical sleeve 17 provides a continuous thread for the lock nut 18 and because of its larger diameter, it is able to withstand much higher forces than previous lock nuts and therefore it is possible to have a bottom end termination which can withstand forces equal to or greater than the minimum tensile capacity of the cable bolt. Whilst it necessitates the reaming of a larger diameter portion at the bottom of the bore hole 21, this is not a detrimental requirement. Furthermore, by providing in one application an air bleed tube along the central axis of the cable bolt, it achieves the two purposes of providing means for supporting the spacers 14 as well as means for allowing air to be discharged from the bore hole 21.

What is claimed is:

1. A cable bolt comprising a plurality of generally closely spaced elongate wires or strands, said wires or strands having a first end adapted for fitting into a bore hole and a second end being terminated within a cylindrical sleeve, said cylindrical sleeve having a threaded external surface to receive a lock nut for tightening against a bearing plate so as to tension said cable bolt, wherein the termination of said second end of wires or strands comprises a transverse plate in said cylindrical sleeve, said transverse plate having individual termination holes for each of said wires or strands and wherein said wires or strands pass through respective individual termination holes and said each wire or strand has an integral enlarged head which is larger than the diameter of said respective termination holes whereby said each wire or strand cannot be withdrawn from said respective individual termination holes.

2. A cable bolt according to claim 1 wherein said wires or strands are separated outwardly from a central longitudinal axis of said cable bolt at discrete spaced locations along the length of said cable bolt to provide a bird-cage shaped structure at each location.

3. A cable bolt according to claim 2 wherein a plurality of spacers are provided at said discrete spaced locations to cause said wires or strands to spread outwardly and form said bird cage shaped structure.

4. A cable bolt according to claim 3 wherein a central elongate tubular member extends along said central longitudinal axis through said cylindrical sleeve and through said spacers whereby each of said spacers has an aperture through which said tubular member passes.

5. A cable bolt according to claim 4 having a resin seal provided at a spaced location from said first end of said wires or strands, said resin seal preventing resin from passing downwardly below said resin seal, said resin being used to bond said first end to a wall of said bore hole formed prior to inserting said cable bolt.

6. A cable bolt according to claim 5 wherein said resin seal comprises a second sleeve that fits over said wires or strands.

7. A cable bolt according to claim 6 wherein said central elongate tubular member is hollow and terminates at an upper end in said resin seal.

8. A cable bolt according to claim 7 wherein said lock nut has a connection for receiving a grout tube, said connection providing access to an annular chamber formed within said lock nut.

9. A cable bolt according to claim 8 wherein said annular chamber, in use, bears against said bearing plate.

10. A cable bolt according to claim 9 wherein said bearing plate has a bore therethrough which is greater in diameter than the outer diameter of said cylindrical sleeve whereby said annular chamber is open to a space between said cable bolt and said wall of said bore hole, whereby grout is pumped through said grout tube and enters said bore hole.

11. A cable bolt according to claim 10 wherein said elongate tubular member provides an air bleed to remove air from said bore hole when grout is being pumped into said bore hole.

12. A cable bolt according to claim 2 wherein said wires or strands are straight and parallel to said central longitudinal axis between each bird cage shaped structure.

13. A cable bolt according to claim 1 having coupling means adapted to fit a lower end of said cylindrical sleeve for rotating said cable bolt.

14. A cable bolt according to claim 13, wherein said coupling means has an external portion which is threaded and adapted to engage an internal thread of said cylindrical sleeve such that upon such engagement and rotation of said coupling means a position of said coupling means is reached where further rotation results in rotation of said cable bolt.

15. A cable bolt according to claim 1 wherein said wires or strands have a slight helical configuration over the length of said cable bolt.

16. A cable bolt comprising a plurality of generally closely spaced elongate wires or strands, said wires or strands having a first end adapted for fitting into a bore hole and a second end being terminated within a cylindrical sleeve, said cylindrical sleeve having a threaded external surface to receive a lock nut for tightening against a bearing plate so as to tension said cable bolt, wherein the termination of said second end of wires of strands comprises a transverse plate in said cylindrical sleeve, said transverse plate having individual termination holes for each of said wires or strands and wherein said wires or strands pass through respective individual termaination holes and said each wire or strand has an integral enlarged head which is larger than the diameter of said respective termination holes, and coupling means adapted to fit a lower end of said cylindrical sleeve for the purpose of rotating said cable bolt, said coupling means including an external portion which is threaded and adapted to engage an internal thread of said cylindrical sleeve such that upon such engagement and rotation of said coupling means a position of said coupling means is reached where further rotation results in rotation of said cable bolt, wherein said coupling means has a connection for receiving a grout tube, said coupling means connection providing access to an annular cavity formed within said coupling means and surrounding a hollow central tubular member.

17. A cable bolt according to claim 16 wherein said annular cavity extends through said cylindrical sleeve and said bearing plate, said bearing plate having a bore therethrough which is greater in diameter than the outer diameter of said cylindrical sleeve, said annular cavity being open to a space between said cable bolt and said wall of said bore hole, whereby grout is pumped through said grout tube and enters said bore hole.

18. A cable bolt according to claim 17 wherein said hollow tubular member acts as an air bleed to remove air from said bore hole when grout is being pumped into said bore hole.

19. A cable bolt according to claim 17 wherein said bearing plate has a trumpet-shaped member welded thereto, said trumpet shaped member comprising a stepped cylindrical tube and adapted to extend a short distance into said bore hole.

20. A cable bolt according to claim 19 further including one or more collar pipes adapted to be inserted into an upper end of said cylindrical sleeve so as to provide stiffening to said first end of said wires or strands.

21. A cable bolt comprising a plurality of generally closely spaced elongate wires or strands, said wires or strands having a first end adapted for fitting into a bore hole and a second end being terminated within a cylindrical sleeve, said cylindrical sleeve having a threaded external surface to receive a lock nut for tightening against a bearing plate so as to tension said cable bolt, and coupling means adapted to fit a lower end of said cylindrical sleeve for the purpose of rotating said cable bolt, wherein said coupling means has an external portion which is threaded and adapted to engage an internal thread of said cylindrical sleeve such that upon such engagement and rotation of said coupling means a position of said coupling means is reached where further rotation results in rotation of said cable bolt, wherein said coupling means has a connection to a grout tube and connecting said grout tube to said hollow central tubular member such that grout is pumped through said grout tube and enters a hollow central tubular member.

22. A cable bolt according to claim 21 wherein said grout after filling said hollow central tubular member exits said member and enters said bore hole.

23. A cable bolt for use in an excavation comprising a plurality of generally closely spaced elongate wires or strands having a first end adapted for fitting into a bore hole formed in said excavation and a second end adapted for bearing against the excavation surface wherein the terminal region of said second end of said wires or strands terminates in a cylindrical sleeve having a threaded external surface adapted to co-operate with a threaded lock nut for tightening said cable bolt against said excavation surface, and wherein the termination of said second end of wires or strands comprises a transverse plate in said cylindrical sleeve, said transverse plate having individual termination holes for each wire or strand and wherein said wires or strands pass through respective individual termination holes and each wire or strand has an integral enlarged head which is larger than the diameter of said respective termination holes whereby said each wire or strand cannot be withdrawn from said respective individual termination holes.

24. A cable bolt according to claim 23 wherein said lock nut tightens against a bearing plate at said excavation surface.

25. A cable bolt according to claim 23 wherein the termination of said second end of said wires or strands comprises a transverse plate in said cylindrical sleeve, said transverse plate having respective termination holes for each of said wires or strands whereby each of said wires or strands pass through said respective termination holes and have an enlarged head which is larger than the diameter of said respective termination holes such that each of said wires or strands cannot be withdrawn from said respective termination holes.

26. A cable bolt according to claim 23 wherein said wires or strands are separated outwardly from a central longitudinal axis of said cable bolt at discrete spaced locations along the length of said cable bolt to provide a bird cage shaped structure at each said spaced location.

27. A cable bolt according to claim 26 wherein spacers are provided at said discrete spaced locations to cause said wires or strands to spread outwardly and form said bird cage shaped structure.

28. A cable bolt according to claim 27 wherein a central elongate tubular member extends along said central longitudinal axis through said cylindrical sleeve and through said spacers whereby each of said spacers has an aperture through which said tubular member passes.

* * * * *